US012241237B2

(12) United States Patent
Cao et al.

(10) Patent No.: US 12,241,237 B2
(45) Date of Patent: Mar. 4, 2025

(54) ADAPTIVE CONTROL METHOD APPLICABLE TO EXCAVATOR, ELECTRONIC DEVICE, EXCAVATOR AND NON-TRANSITORY STORAGE MEDIUM

(71) Applicant: SANY HEAVY MACHINERY LIMITED, Kunshan (CN)

(72) Inventors: Donghui Cao, Kunshan (CN); Jianpeng Shi, Kunshan (CN); Xiaozhong Liu, Kunshan (CN)

(73) Assignee: SANY HEAVY MACHINERY LIMITED, Kunshan (CN)

( * ) Notice: Subject to any disclaimer, the term of this patent is extended or adjusted under 35 U.S.C. 154(b) by 295 days.

(21) Appl. No.: 17/957,113

(22) Filed: Sep. 30, 2022

(65) Prior Publication Data

US 2023/0025156 A1 Jan. 26, 2023

Related U.S. Application Data

(63) Continuation-in-part of application No. PCT/CN2022/078485, filed on Feb. 28, 2022, and a (Continued)

(30) Foreign Application Priority Data

May 19, 2021 (CN) ..... 202110546170.X
May 24, 2021 (CN) ..... 202110568521.7

(51) Int. Cl.
*E02F 9/26* (2006.01)
*E02F 9/20* (2006.01)

(52) U.S. Cl.
CPC ..... *E02F 9/265* (2013.01); *E02F 9/2012* (2013.01)

(58) Field of Classification Search
CPC ..... E02F 9/265; E02F 9/2012
See application file for complete search history.

(56) References Cited

U.S. PATENT DOCUMENTS

2006/0229786 A1 10/2006 Sawada
2008/0319618 A1* 12/2008 Sjogren ..... F02D 41/021 123/379

(Continued)

FOREIGN PATENT DOCUMENTS

CN 1651666 A 8/2005
CN 102021926 A 4/2011

(Continued)

OTHER PUBLICATIONS

First Office Action issued in counterpart Chinese Patent Application No. 202110546170.X, dated Apr. 22, 2022.

(Continued)

*Primary Examiner* — James J Lee
*Assistant Examiner* — Steven Vu Nguyen
(74) *Attorney, Agent, or Firm* — Westbridge IP LLC

(57) ABSTRACT

Disclosed is an adaptive control method applicable to an excavator. The adaptive control method includes: acquiring detection parameters of the excavator, the detection parameters comprising a displacement of an electric control handle of the excavator and angle information of the excavator; identifying a current working condition of the excavator based on the detection parameters; and adjusting control parameters of the excavator based on the current working condition. According to the adaptive control method provided by the present disclosure, the current working condition is identified by using the displacement of the electric control handle and the angle information of the excavator, and then the control parameters of the excavator are adjusted based on the current working condition, so that the control parameters are automatically adjusted with change of the (Continued)

current working condition, which improves control efficiency of the excavator.

18 Claims, 8 Drawing Sheets

Related U.S. Application Data continuation-in-part of application No. PCT/CN2022/074317, filed on Jan. 27, 2022.

(56) References Cited

U.S. PATENT DOCUMENTS

| | | | | |
|---|---|---|---|---|
| 2016/0003171 | A1 | 1/2016 | Ge | |
| 2018/0305900 | A1 | 10/2018 | Letscher et al. | |
| 2018/0338059 | A1 | 11/2018 | Ohigashi et al. | |
| 2022/0106773 | A1* | 4/2022 | Iwasaki | E02F 9/123 |
| 2022/0135036 | A1* | 5/2022 | Dongare | E02F 3/437 701/70 |

FOREIGN PATENT DOCUMENTS

| | | | |
|---|---|---|---|
| CN | 103076042 | A | 5/2013 |
| CN | 103277201 | A | 9/2013 |
| CN | 104947732 | A | 9/2015 |
| CN | 109024751 | A | 12/2018 |
| CN | 110905034 | A | 3/2020 |
| CN | 110905674 | A | 3/2020 |
| CN | 111441416 | A | 7/2020 |
| CN | 112012837 | A | 12/2020 |
| CN | 112734246 | A | 4/2021 |
| CN | 113202642 | A | 8/2021 |
| CN | 113216311 | A | 8/2021 |
| KR | 20200092852 | A | 8/2020 |
| WO | 2020157046 | A1 | 8/2020 |
| WO | 2020255970 | A1 | 12/2020 |
| WO | 2021065813 | A1 | 4/2021 |

OTHER PUBLICATIONS

First Office Action issued in counterpart Chinese Patent Application No. 202110568521.7, dated Nov. 1, 2022.

International Search Report issued in corresponding PCT Application No. PCT/CN2022/074317, dated Apr. 26, 2022.

International Search Report issued in corresponding PCT Application No. PCT/CN2022/078485, dated May 19, 2022.

Notification to Grant Patent Right for Invention issued in counterpart Chinese Patent Application No. 202110546170.X, dated Jul. 14, 2022.

European Search Report issued in counterpart European Patent Application No. EP 22773393.8, dated Sep. 22, 2023.

* cited by examiner

ADAPTIVE CONTROL METHOD APPLICABLE TO EXCAVATOR, ELECTRONIC DEVICE, EXCAVATOR AND NON-TRANSITORY STORAGE MEDIUM

CROSS-REFERENCE TO RELATED APPLICATIONS

This application is a continuation-in-part of International Application No. PCT/CN2022/078485, filed on Feb. 28, 2022, which claims priority to Chinese Patent Application No. 202110546170.X, filed on May 19, 2021. This application is also a continuation-in-part of International Application No. PCT/CN2022/074317, filed on Jan. 27, 2022, which claims priority to Chinese Patent Application No. 202110568521.7, filed on May 24, 2021. All of the aforementioned patent applications are hereby incorporated by reference in their entireties.

TECHNICAL FIELD

The present disclosure relates to a technical field of an excavator, in particular to an adaptive control method, an electronic device, an excavator, and a non-transitory storage medium.

BACKGROUND

As an important building construction and mining device, excavators play a very important role in many fields such as engineering construction and ore mining. More than 60% of earthwork operations in the world are performed by the excavators.

Excavators are usually hydraulically driven to operate, and use a single or multiple pumps to drive multiple actuators such as a boom, a stick, a bucket and a swing platform, which belong to a single power source multi-actuator system. When an excavator performs compound actions, an operating speed of each actuator is determined by flow distribution of a hydraulic system, and proportion of the flow distribution is directly related to working conditions and loads. In the related art, as for some common working conditions, the excavator may preset matching working condition modes when leaving the factory, and different working condition modes correspond to different priority parameters of the flow distribution. During operation, the driver may adjust the priority parameters of the flow distribution by switching the working condition modes, so that the adjusted priority parameters match the current working condition. However, in order to realize the adjustment of the priority parameters corresponding to the current working condition, it requires the driver to select the working condition modes according to actual experience. This requires the driver to manually select and switch the working condition modes, which is less efficient and less responsive. In addition, in an actual operation, the working conditions of the excavator changes frequently. Every time the working condition changes, the driver needs to switch the working condition modes (for example, select and switch the working condition modes by operating a button). Frequent switching of the working condition modes brings a burden to the driver and reduces operating efficiency and user experience of the operator.

SUMMARY

In view of this, the present disclosure provides an adaptive control method, an electronic device, an excavator, and a non-transitory storage medium storage medium.

In a first aspect, the present disclosure provides an adaptive control method applicable to an excavator, including: acquiring detection parameters of the excavator, the detection parameters including a displacement of an electric control handle of the excavator and angle information of the excavator, the excavator includes a plurality of actuators, the plurality of actuators include a plurality of action mechanisms and a swing platform, and the angle information includes inclination angles of the plurality of action mechanisms and a swing angle of the swing platform; identifying a current working condition of the excavator based on the detection parameters; and adjusting control parameters of the excavator based on the current working condition.

In the adaptive control method provided by the present disclosure, the control parameters of the excavator are adjusted based on the identified current working condition, so that the control parameters are automatically adjusted with change of the current working condition, which improves control efficiency of the excavator. In addition, combining the displacement of the electric control handle and the angle information of the excavator to identify the current working condition may ensure the reliability of identification of the working condition.

With reference to the first aspect, in some embodiments, the identifying a current working condition of the excavator based on the detection parameters includes: acquiring relative positions of the plurality of action mechanisms; determining a lift height of the excavator based on the inclination angles and the relative positions; determining target speeds of the plurality of actuators based on the displacement and a correspondence between speeds of the plurality of actuators and the displacement of the electric control handle; and determining the current working condition based on the angle information, the lift height, and the target speeds.

The adaptive control method provided by the present disclosure combines the inclination angles, the swing angle and the target speeds to determine the current working condition, so as to realize the accuracy of the identification of the working condition.

With reference to the first aspect, in some embodiments, the determining a lift height of the excavator based on the inclination angles and the relative positions includes: determining a spatial coordinate of a tooth tip of the excavator at each time based on the inclination angles and the relative positions; determining a motion trajectory of the tooth tip based on the spatial coordinate of the tooth tip at each time; and determining a height difference between a crawler of the excavator and a working surface of the excavator based on the motion trajectory of the tooth tip, so as to determine the lift height.

In the adaptive control method provided by the present disclosure, the lift height is determined based on the motion trajectory of the tooth tip and the relative positions of the plurality of action mechanisms, and then the lift height is determined from the perspective of kinematic coordinate transformation, thus ensuring the accuracy of the determination of the lift height.

With reference to the first aspect, in some embodiments, the determining the current working condition based on the angle information, the lift height, and the target speeds includes: determining that the excavator is currently in a first mode based on the lift height, the first mode being one of a platform building operation and a ground operation; determining that the excavator is currently in a second mode based on the inclination angles and the target speeds, the second mode being one of a loading operation and a dumping operation; determining that the excavator is currently in a third mode based on the swing angle, the third mode being one of a plurality of swing operations with different swing angles; and determining the current working condition based on the first mode, the second mode and the third mode.

In the adaptive control method provided by the present disclosure, by synthesizing the first mode, the second mode and the third mode, the current working condition is finally determined, and then an identification result of the working condition is obtained by using a signal, thus ensuring the reliability of the identification of the working condition.

With reference to the first aspect, in some embodiments, the determining that the excavator is currently in a first mode based on the lift height includes: determining whether the lift height exceeds a height threshold; determining that the excavator is in the platform building operation when the lift height does not exceed the height threshold; and determining that the excavator is in the ground operation when the lift height exceeds the height threshold.

In this way, it is possible to accurately determine in which of the platform building operation and the ground operation is in.

With reference to the first aspect, in some embodiments, the determining that the excavator is currently in a second mode based on the inclination angles and the target speeds includes: determining speed of the electric control handle based on the displacement of the electric control handle; determining target accelerations of the plurality of actuators based on the speed of the electric control handle; and determining that the excavator is currently in the second mode based on the inclination angles, the target speeds, and the target accelerations.

In the adaptive control method provided by the present disclosure, on the basis of the target speeds, the second mode is confirmed in combination with the target accelerations, which further ensures the accuracy of a determination result.

In some embodiments, the plurality of action mechanisms include a boom, a stick and a bucket.

With reference to the first aspect, in some embodiments, the control parameters include a pump current and a priority gain, the adjusting control parameters of the excavator based on the current working condition includes: determining target control parameters based on the current working condition and an optimization target, the optimization target including minimum fuel consumption and maximum efficiency; and adjusting the control parameters based on the target control parameters.

In the adaptive control method provided by the present disclosure, the control parameters are optimized by using the optimization target, so that the optimized control parameters can meet the requirements.

With reference to the first aspect, in some embodiments, the control parameters include a speed of an engine of the excavator, the adjusting control parameters of the excavator based on the current working condition includes: determining, based on the current working condition, an action execution sequence of the excavator in an operation cycle; determining an action duration corresponding to each action of a plurality of actions in the operation cycle; obtaining torque information of each action; determining, based on the torque information and a relationship between a torque and a speed under preset optimal fuel consumption, a target speed, corresponding to each action, of an engine; and controlling, according to the action execution sequence, and the action duration and the target speed that are corresponding to each action, the speed of the engine when the excavator repeats the operation cycle.

With reference to the first aspect, in some embodiments, the controlling, according to the action execution sequence, and the action duration and the target speed that are corresponding to each action, a speed of the engine includes: controlling the engine to run at a target speed corresponding to a current action within an action duration corresponding to the current action.

With reference to the first aspect, in some embodiments, the determining an action duration corresponding to each action in a plurality of actions in the operation cycle includes: monitoring an action current of the electric control handle; and determining, based on the action execution sequence and the action current, the action duration corresponding to each action in the plurality of actions.

With reference to the first aspect, in some embodiments, the determining, based on the action execution sequence and the action current, the action duration corresponding to each action in the plurality of actions includes: sequentially determining, based on the action execution sequence and an amplitude change of the action current, a first action duration corresponding to each action in a same operation cycle; and obtaining the first action durations of each action in a plurality of operation cycles, and calculating an average value of the first action durations corresponding to each action, to obtain the action duration corresponding to each action.

With reference to the first aspect, in some embodiments, the sequentially determining, based on the action execution sequence and an amplitude change of the action current, a first action duration corresponding to each action in a same operation cycle includes: determining a first moment and a second moment of the current action based on the amplitude change of the action current, wherein the first moment is a start moment of an action, and the second moment is an end moment of an action; and calculating, based on the first moment and the second moment, a first action duration corresponding to the current action.

With reference to the first aspect, in some embodiments, the determining a first moment and a second moment of the current action based on the amplitude change of the action current includes: in a case that a period during which an amplitude of the action current is greater than a first threshold exceeds a first period, determining that a moment at which the amplitude of the action current rises to the first threshold is the first moment; and in a case that a period during which an amplitude of the action current is less than a second threshold exceeds a second period, determining that a moment at which the amplitude of the action current drops to the second threshold is the second moment, wherein the first threshold is greater than or equal to the second threshold.

With reference to the first aspect, in some embodiments, before the calculating, based on the first moment and the second moment, a first action duration corresponding to the current action, the method further includes: calculating a time difference between the second moment of the current action and a first moment of a next action; determining whether the time difference is less than a third period; and in a case that the time difference is less than the third period, determining that the next action belongs to the current action, and updating the second moment of the current action to a second moment of the next action.

With reference to the first aspect, in some embodiments, the method further includes: when the excavator starts to run, determining whether the excavator starts an action mode; in response to the excavator starting the action mode, controlling the engine to run at a first speed, and in response to the excavator not starting the action mode, controlling the engine to run at a second speed, wherein the second speed is less than the first speed.

With reference to the first aspect, in some embodiments, the method further includes: in a case that it is monitored that the excavator has not started the action mode for a fourth period, controlling the engine to run at a third speed, wherein the third speed is less than the second speed.

In a second aspect, the present disclosure also provides an electronic device, including: a processor; and a memory having program instructions stored thereon and coupled to the processor. When the program instructions are executed by the processor, the processor executes the adaptive control method described in the first aspect.

In a third aspect, the present disclosure also provides an excavator, including the electronic device described in the third aspect.

In a fourth aspect, the present disclosure also provides a non-transitory storage medium having program instructions stored thereon. When the program instructions are executed by a processor, the processor executes the adaptive control method described in the first aspect.

BRIEF DESCRIPTION OF THE DRAWINGS

In order to explain the embodiments of the present disclosure more clearly, the accompanying drawings that need to be used may be briefly introduced below. Obviously, the accompanying drawings in the following description are some embodiments of the present disclosure. For those skilled in the art, other drawings may also be obtained from these accompanying drawings without creative efforts.

DETAILED DESCRIPTION OF THE EMBODIMENTS

Figure 1:
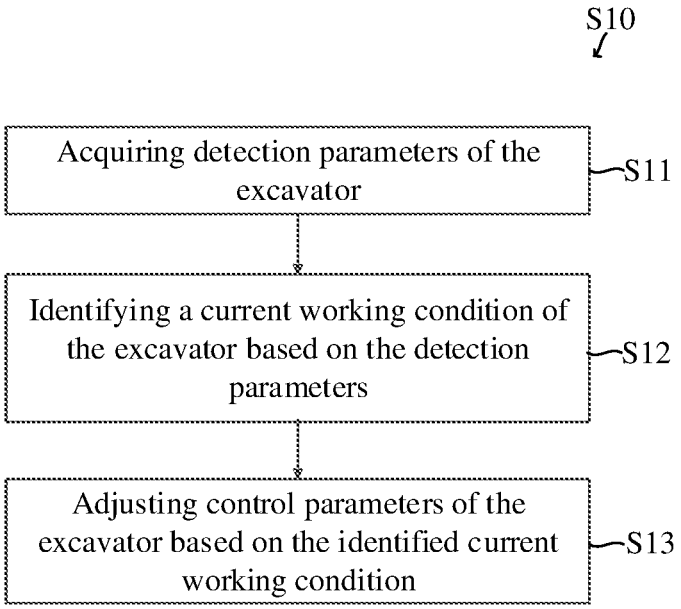
FIG. 1 is a schematic flowchart of an adaptive control method according to an embodiment of the present disclosure.

In order to make the purposes, technical solutions and advantages of the present disclosure clearer, the technical solutions in the embodiments of the present disclosure may be clearly and completely described below in combination with the accompanying drawings in the embodiments of the present disclosure. Apparently, the described embodiments are only a part, but not all, of the embodiments of the present disclosure. All of the other embodiments that are obtained by those of ordinary skill in the art based on the embodiments in the present disclosure without any inventive efforts fall into the scope protected by the present disclosure.

In the related art, a plurality of working condition buttons corresponding to a plurality of working conditions are arranged in a cab of an excavator. The driver may select a corresponding working condition button according to a current working condition, so that control parameters of actuators of the excavator may better match the current working condition of the excavator. When the working condition of the excavator changes, in order to ensure that the control parameters keep matching the changed working condition, the driver needs to select a corresponding working condition button one more time. However, due to a limited space in the cab, it is impossible to set enough working condition buttons to correspond to all possible working conditions, which results in that when a working condition that does not correspond to all the working condition buttons occurs, the driver cannot adjust optimization parameters to match the working condition. It can be seen that in the related art, control accuracy of the excavator is poor.

The present disclosure provides an adaptive control method applicable to an excavator. In the adaptive control method, the current working condition of the excavator is adaptively identified, and the control parameters of the excavator are automatically adjusted based on a result of adaptive identification, so as to realize adaptive adjustment of the control parameters.

In the adaptive control method provided by the present disclosure, the current working condition can be automatically identified based on a displacement of the electric control handle and measurement results of angle sensors. For example, various working conditions are composed of a plurality of operations such as a platform building operation/a ground operation, a loading operation/a dumping operation, a swing operation with 45-degree/90-degree/180-degree/another angle, etc. In addition, in the adaptive control method provided by the present disclosure, the control parameters of the excavator can be automatically adjusted after the current working condition is identified, without manual setting and selection by the driver. For example, the adaptive control method provided by the present disclosure may be applied to the excavator using the electric control handle and the angle sensors.

It should be noted that, in the present disclosure, the steps shown in the flowcharts may be executed in a computer system such as a set of computer-executable instructions stored therein. Furthermore, although a logical order is shown in the flowcharts, in some cases the steps shown or described may be performed in an order different from that herein.

FIG. 1 is a schematic flowchart of an adaptive control method S10 according to an embodiment of the present disclosure. The adaptive control method S10 may be performed by an electronic device (e.g., a control device of an excavator). As shown in FIG. 1, the adaptive control method S10 may include steps S11 to S13.

Step S11: acquiring detection parameters of the excavator. The detection parameters include a displacement of an electric control handle of the excavator and angle information of the excavator.

During a detection period, the displacement of the electric control handle may be determined by an electric signal output by the electric control handle. Based on the displacement of the electronic control handle, target speed or target acceleration of the excavator may be determined in the subsequent steps, so that working data of the excavator may be determined. For example, a loading operation working cycles may mainly include the following actions: digging-lifting-turning-unloading-returning. At each action, the target speed or target acceleration of each actuator of the excavator may change accordingly. Or at each action, the target speed or target acceleration of each actuator of the excavator may follow a certain variation law. Therefore, the displacement of the electronic control handle may be used to determine the working data of the excavator.

The angle information may include a measured swing angle of the swing platform of the excavator, and may also include measured inclination angles of a plurality of action mechanisms of the excavator. For example, in one detection cycle, by measuring the inclination angles of a boom, a variation law of the boom in one detection cycle may be determined. For another example, in one detection cycle, a lift height of the excavator may be determined by measuring a motion trajectory of a tooth tip of the excavator.

In the embodiment of the present disclosure, the angle information may be obtained by using the angle sensors, or the angle information may be obtained by means of image analysis. The embodiment of the present disclosure does not specifically limit the way of obtaining the angle information, and the way of obtaining the angle information may be set correspondingly according to the actual situations. Taking the implementation with angle sensors as an example, measurement results (i.e., the angle information) obtained by the angle sensors may be sent to the electronic device, and thus, the electronic device has got the detection parameters of the excavator.

Step S12: identifying a current working condition of the excavator based on the detection parameters.

After the electronic device has got the detection parameters, the displacement of the electric control handle may be first analyzed to determine the working data of the excavator, and then the current working condition of the excavator may be further confirmed combined with the measurement results of various angle sensors.

In one example, the working conditions able to be identified by the electronic device include at least 16 types which are composed of various operations such as the ground operation/platform building operation, the loading operation/dumping operation, the swing operation with 45-degree/90-degree/180-degree/other angle, etc. (for example, a platform building and dumping working condition with 90-degree is one of the working conditions).

Step S13: adjusting control parameters of the excavator based on the identified current working condition.

The control parameters corresponding to various working conditions may be stored in the electronic device. For example, these control parameters may be stored in a form of a data table. After the current working condition is determined, through the electronic device, the working condition may be matched in the data table, and the corresponding control parameters may be extracted when the same working condition as the current working condition is matched.

For example, the control parameters may include a pump current and a priority gain. The pump current may be a pump current corresponding to each action mechanism in the excavator. The priority gain may be a priority gain of the swing platform to the boom, a priority gain of the swing platform to a stick, a priority gain of the stick to a bucket, and so on. The specific pump current and specific priority gain included in the control parameters are not limited here, and may be set according to the actual situations.

In the adaptive control method provided in this embodiment, the current working condition is identified by using the displacement of the electric control handle of the excavator and the angle information of the excavator, and then the control parameters of the excavator are adjusted based on the current working condition, so as to realize that the control parameters are automatically adjusted with the change of the current working condition, and the control efficiency of the excavator is improved.

Figure 2:
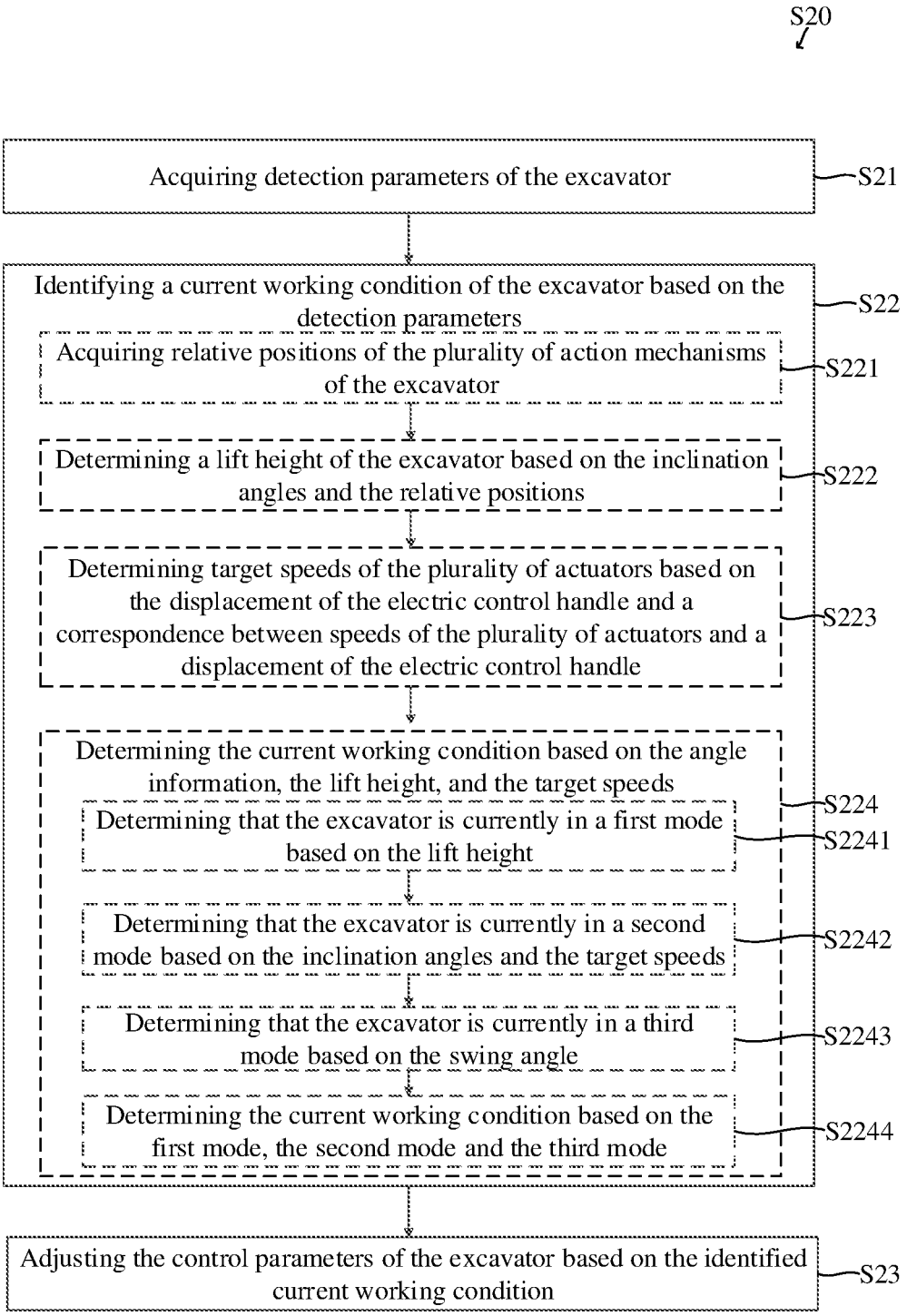
FIG. 2 is a schematic flowchart of an adaptive control method according to another embodiment of the present disclosure.

FIG. 2 is a schematic flowchart of an adaptive control method S20 according to another embodiment of the present disclosure. The adaptive control method S20 may be performed by an electronic device (e.g., a control device of an excavator). As shown in FIG. 2, the adaptive control method S20 may include steps S21 to S23.

Step S21: acquiring detection parameters of the excavator. The detection parameters include a displacement of an electric control handle of the excavator and angle information of the excavator.

The angle information includes inclination angles and a swing angle. The inclination angles may be inclination angles of a plurality of action mechanisms of the excavator. For example, the plurality of action mechanisms include a boom, a stick and a bucket, etc. The swing angle may be a swing angle of the swing platform of the excavator. In the present disclosure, the angle information may be set according to the actual needs, which is not limited herein. By using a swing angle sensor, change amplitude of the swing angle and a swing direction in a loading cycle are acquired through the electronic device, and therefore, the swing angle of the excavator during operation may be identified.

Step S22: identifying a current working condition of the excavator based on the detection parameters.

As an embodiment, the step S22 may include steps S221 to S224.

Step S221: acquiring relative positions of the plurality of action mechanisms of the excavator.

Through the electronic device, a coordinate system (e.g., a XOY coordinate system) may be established with a tooth tip of the excavator (e.g., a bucket) as a coordinate center point. Since a size of each action mechanism in the excavator is fixed, a coordinate of each action mechanism in the coordinate system may be determined, so that the relative position of each action mechanism may be determined.

For example, the relative position of each action mechanism may be pre-stored in the electronic device. For another example, through the electronic device, a coordinate system may be established in real time and the relative position of each action mechanism may also be determined in real time when self-adaptive control is required. Of course, through the electronic device, the relative position of each action mechanism in the excavator may also be acquired in other ways. The present disclosure does not specifically limit the manner of how to acquire the relative position of each action mechanism in the excavator through electronic device.

Step S222: determining a lift height of the excavator based on the inclination angles and the relative positions.

As described above, the inclination angles may include the inclination angles of the boom, the stick, and the bucket. Therefore, through the electronic device, the lift height of the excavator may be determined according to the inclination angles of the corresponding action mechanisms and their relative positions.

As a specific embodiment, the step S222 may include: determining a spatial coordinate of a tooth tip of the excavator at each time based on the inclination angles and the relative positions; determining a motion trajectory of the tooth tip based on the spatial coordinate of the tooth tip at each time; and determining a height difference between a crawler of the excavator and a working surface of the excavator based on the motion trajectory of the tooth tip, so as to determine the lift height.

By using inclination sensors, through the electronic device, an angle of each action mechanism (i.e., the boom, stick and bucket) at each time may be obtained, and combined with the relative position of each action mechanism (or a geometric dimension of the boom, stick and bucket and a dimension of a hydraulic cylinder), the spatial coordinate of the tooth tip of the excavator may be obtained according to a space coordinate operation. Through the electronic device, the motion trajectory of the tooth tip may be determined by recording the spatial coordinate of the tooth tip at each time. Through the electronic device, a height of a crawler of the excavator relative to a working surface of the excavator may be identified by using the motion trajectory of the tooth tip during an excavation process, so as to determine the lift height.

As an example, the working surface of the excavator may refer to a plane on which the tooth tip of the bucket are located when the bucket of the excavator is lifted to the highest level in the current operation, or the working surface of the excavator may be a plane on which the highest point of the motion trajectory of the tooth tip is located. As an example, the lift height may be a height difference between the crawler of the excavator (or a plane supporting the crawler) and the working surface of the excavator.

The lift height is determined based on the motion trajectory of the tooth tip and the relative position of each action mechanism, and the lift height is determined from a perspective of kinematic coordinate conversion, which ensures the accuracy of determining the lift height.

Step S223: determining target speeds of the plurality of actuators based on the displacement of the electric control handle and a correspondence between speeds of the plurality of actuators and a displacement of the electric control handle.

In one example, the correspondence between speeds of the plurality of actuators and the displacement of the electric control handle may be stored in the electronic device, and the correspondence may be characterized by a relationship curve. After the displacement of the electric control handle is obtained, through the electronic device, the target speeds of the plurality of actuators may be determined by looking up the relationship curve.

Step S224: determining the current working condition based on the angle information, the lift height, and the target speeds.

As described above, the target speeds can characterize the working data of the excavator. Therefore, through the electronic device, the current working condition may be determined by combining the angle, lift height and target speeds.

In a specific embodiment, the step S224 may include steps S2241 to S2244.

Step S2241: determining that the excavator is currently in a first mode based on the lift height. The first mode is one of a platform building operation and a ground operation.

By comparing the lift height with a height threshold, a current mode of the excavator may be determined, that is, which of the platform building operation and the ground operation the excavator is currently in.

As an example, the step S2241 may include determining whether the lift height exceeds a height threshold; determining that the excavator is in the platform building operation when the lift height does not exceed the height threshold; and determining that the excavator is in the ground operation when the lift height exceeds the height threshold.

Step S2242: determining that the excavator is currently in a second mode based on the inclination angles and the target speeds. The second mode is one of a loading operation and a dumping operation.

In a detection cycle, the working data of the excavator may be characterized by the target speeds, and working characteristics of the excavator may be expressed by the target speeds. Based on the working characteristics and the inclination angles, through the electronic device, it may be determined which of the loading operation and the dumping operation is currently performed by the excavator.

Step S2243: determining that the excavator is currently in a third mode based on the swing angle. The third mode is one of a plurality of swing operations with different swing angles.

For example, various swing operations may include a swing operation with a swing angle of 45 degrees, a swing operation with a swing angle of 90 degrees, a swing operation with a swing angle of 180 degrees, a swing operation with other swing angles, and the like. Based on the detected swing angle, through the electronic device, it may be determined which of various swing operations the excavator is currently in. For example, if the detected swing angle is close to 90 degrees, it may be determined that the excavator is currently in the swing operation with the swing angle of 90 degrees, i.e., a current swing platform of the excavator needs to be rotated 90 degrees for operation.

Step S2244: determining the current working condition based on the first mode, the second mode and the third mode.

By combining the first mode, the second mode and the third mode, the current working condition of the excavator may be finally determined through the electronic device. For example, if the determined first mode is the ground operation, the determined second mode is the loading operation, and the determined third mode is the swing operation with the swing angle of 90 degrees, then by combining these information, it may be determined that the current working condition of the excavator is 90-degree leveling loading. For another example, if the determined first mode is the platform building operation, the determined second mode is the dumping operation, and the determined third mode is the swing operation with the swing angle of 45 degrees, then by combining these information, it may be determined that the current working condition of the excavator is 45-degree platform building dumping.

By synthesizing the first mode, the second mode and the third mode, the current working condition is finally determined, which may ensure the reliability of determining the current working condition.

In a specific embodiment, the step S2242 may include: determining speed of the electric control handle based on the displacement of the electric control handle; determining target accelerations of the plurality of actuators based on the speed of the electric control handle; and determining that the excavator is currently in the second mode based on the inclination angles, the target speeds, and the target accelerations.

There is a correspondence between the displacement and the speed of the electric control handle. After the displacement of the electric control handle is obtained, through the electronic device, the speed of the electric control handle may be obtained by using the correspondence. For example, the speed of the electric control handle may be obtained through the displacement of the electric control handle and a corresponding time. Through the electronic device, a differential calculation is performed on the obtained speed of the electric control handle to determine the target accelerations of the excavator. For example, when the driver operates the electric control handle, the speed of moving the electric control handle (i.e., the speed of the electric control handle) is related to acceleration of the excavator expected by the driver. The faster the driver moves the electric control handle, the faster the driver expects the excavator to respond to changes in speed. On the basis of the target speeds, the working characteristics of the excavator are determined in combination with the target accelerations, which further ensures the accuracy of a determination result.

Step S23: adjusting the control parameters of the excavator based on the identified current working condition. The control parameters include a pump current and a priority gain.

It should be noted that, for a specific embodiment of the step S23, reference may be made to the step S13 in the foregoing embodiment, which is not repeated here for the sake of brevity.

In the adaptive control method provided in this embodiment, the inclination angles, the swing angle and the target speeds are combined to determine the current working condition, so as to realize the accuracy of identifying the working condition.

Figure 3:
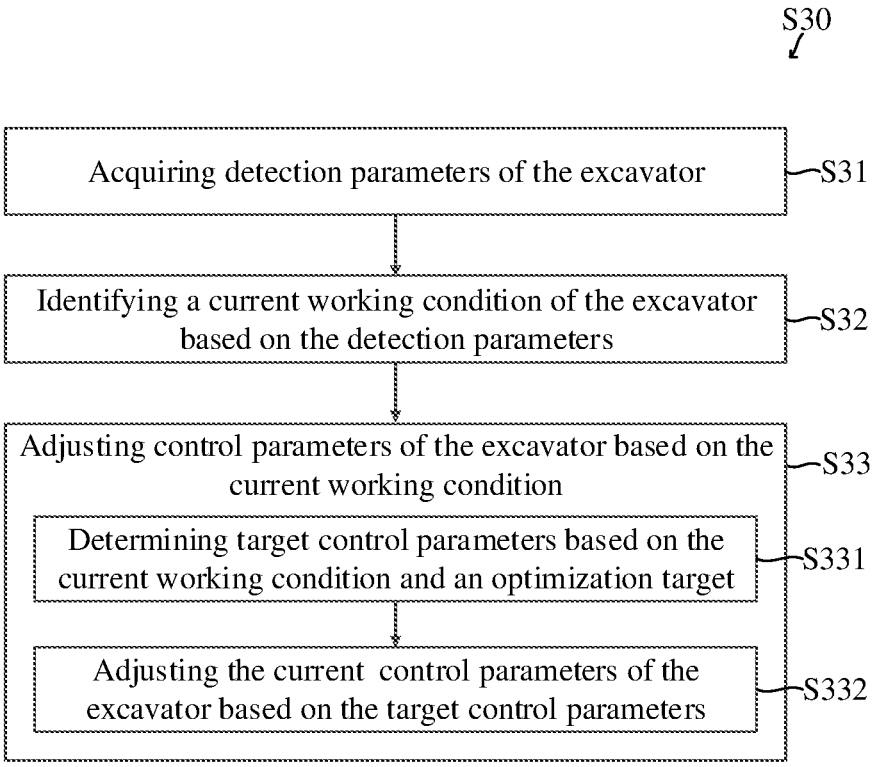
FIG. 3 is a schematic flowchart of an adaptive control method according to another embodiment of the present disclosure.

FIG. 3 is a flowchart of an adaptive control method of a step S30 according to another embodiment of the present disclosure. The adaptive control method of the step S30 may be performed by an electronic device (e.g., a control device of an excavator). As shown in FIG. 3, the adaptive control method of the step S30 may include steps S31 to S33.

Step S31: acquiring detection parameters of the excavator. The detection parameters include a displacement of an electric control handle of the excavator and angle information of the excavator.

For a specific embodiment of the step S31, reference may be made to the step S21 in the above embodiment, and for the sake of brevity, details are not described herein again.

Step S32: identifying a current working condition of the excavator based on the detection parameters.

Figure 4:
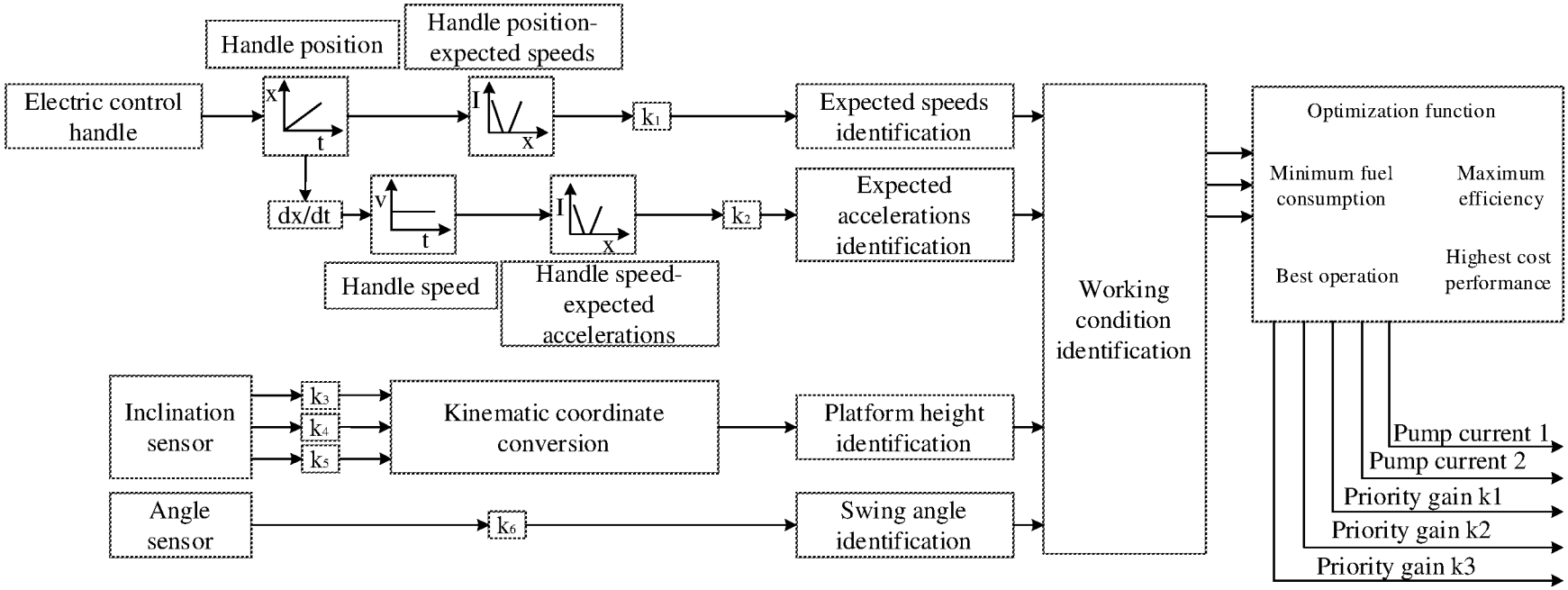
FIG. 4 is a schematic processing diagram of an adaptive control method according to an embodiment of the present disclosure.

As for the identification of the current working condition of the excavator, as shown in FIG. 4, input parameters are the displacement of the electric control handle, inclination angles of a plurality of action mechanisms, and a swing angle of a swing platform, and an output is a pump current and a priority gain. For example, inclination sensors may be provided in the excavator to acquire the inclination angles of the plurality of action mechanisms, and a swing angle sensor may be provided in the excavator to detect the swing angle of the swing platform. Considering that a position of the electric control handle corresponds to an operating speed of a plurality of actuators of the excavator during operation, the driver's expected speed may be identified according to the position of the electric control handle, and the driver's expected acceleration may be identified according to a speed of the electric control handle. In addition, the lift height of the excavator may be determined according to the inclination angles of the plurality of action mechanisms. In addition, an angle that the swing platform has turned during the operation may be determined according to the swing angle. Comprehensively, the current working condition of the excavator may be identified. According to the identified current working condition, aiming at the lowest fuel consumption and the highest efficiency, the pump current and priority gain are automatically adjusted to automatically adapt to the current working condition, so that each action gain coefficient is more suitable for the current working condition. In this embodiment, there is no need for the driver to repeatedly adjust manually, which can reduce the difficulty of the operation and increase the working efficiency.

As an example, a display screen or button etc. may be provided on the excavator for the driver to activate/deactivate an adaptive mode. After the driver chooses to enter the adaptive mode, through the electronic device (such as the control device of the excavator), corresponding parameters may be automatically adjusted according to different working conditions, so as to automatically adapt to different working conditions.

Step S33: adjusting control parameters of the excavator based on the current working condition. The control parameters may include a pump current and a priority gain. In a non-limiting example, the step S33 may include step S331 and step S332.

Step S331: determining target control parameters based on the current working condition and an optimization target. The optimization target includes minimum fuel consumption and maximum efficiency.

After the current working condition is identified, through the electronic device, the control parameter corresponding to the current working condition may be determined in combination with the current working condition and the optimization target, i.e., the target control parameter. Specifically, as shown in FIG. 4, the optimization target may include the minimum fuel consumption, maximum efficiency, best operation, and highest cost performance. After constraints corresponding to each optimization target are determined, an optimization function may be used to optimize the control parameters, and then the target control parameters corresponding to the current working condition may be determined.

It should be understood that although only two pump currents and three priority gains are shown in FIG. 4, the protection scope of the present disclosure is not limited to this, and specific settings may be made according to the actual needs.

Step S332: adjusting the (current) control parameters of the excavator based on the target control parameters.

After the target control parameters are determined, through the electronic device, a value of the current control parameter may be adjusted (for example, the current control parameter is adjusted to be consistent with the target control parameter), thereby realizing adaptive control of the excavator.

In the adaptive control method provided in this embodiment, the optimization target is used to optimize the control parameters, so that the optimized control parameters can meet the requirements.

As shown in FIG. 4, in the adaptive control method of the present disclosure, the working condition of the excavator is automatically identified according to signals such as the displacement of the electric control handle, the speed of the electric control handle, the inclination angles of the action mechanism, and the swing angle of the swing platform. Using the above signals to identify the working condition can make the identification of the working condition more specific. In the related art, the inclination angles of the action mechanism and the swing angle of the swing platform are not included, so only some simple working conditions (such as light or heavy load, excavation or crushing) can be roughly identified, and it is difficult to accurately determine the working condition.

Further, according to the identified working condition, the pump current and priority gain are automatically adjusted to automatically adapt to different working conditions, so that the gain coefficient of each action is more suitable for the current working condition, without the driver's repeated manual adjustment, reducing the operation difficulty and increasing the working efficiency.

Specifically, the input signals of the adaptive control method in the present disclosure are: the displacement of the electric control handle, the speed of the electric control handle, and the inclination angles and swing angle detected by the angle sensors. For example, the working conditions that can be identified may include at least 16 working conditions which are composed of various operations such as the ground operation/platform building operation, the loading operation/dumping operation, the swing operation with 45-degree/90-degree/180-degree/other angle, etc. (for example, a platform building and dumping working condition with 90-degree is one of the working conditions). The output pump current and the priority gain of each action are automatically adjusted according to the identified working condition, and the driver is not required to manually set and select the working condition.

As an alternative embodiment, a display screen or button etc. may be provided on the excavator for the driver to activate/deactivate an adaptive mode. After the driver chooses to enter the adaptive mode, through the electronic device (such as the control device of the excavator), corresponding parameters may be automatically adjusted according to different working conditions, so as to automatically adapt to different working conditions. It should be understood that the implementation of activating/deactivating the adaptive mode is not limited to the button, display screen, etc. In other embodiments, other implementations may also be adopted.

Most excavators perform various engineering operations based on power sources provided by engines. In addition to adjusting the pump current and the priority gain, adjusting the engine speed is also a way used to reduce fuel consumption and improve efficiency. A common way to adjust the engine speed is adjusting a speed in real time, which has an advantage of theoretically making engine fuel consumption at the lowest level in real time. However, the excavator needs to perform a plurality of actions repeatedly in an actual working condition. Thus, such a way of adjusting the engine speed in real time seriously affects continuity between actions of the excavator. In addition, additional consumption is caused in a process of frequent speed adjustment, making it difficult for actual fuel consumption to achieve a desired effect.

Figure 5:
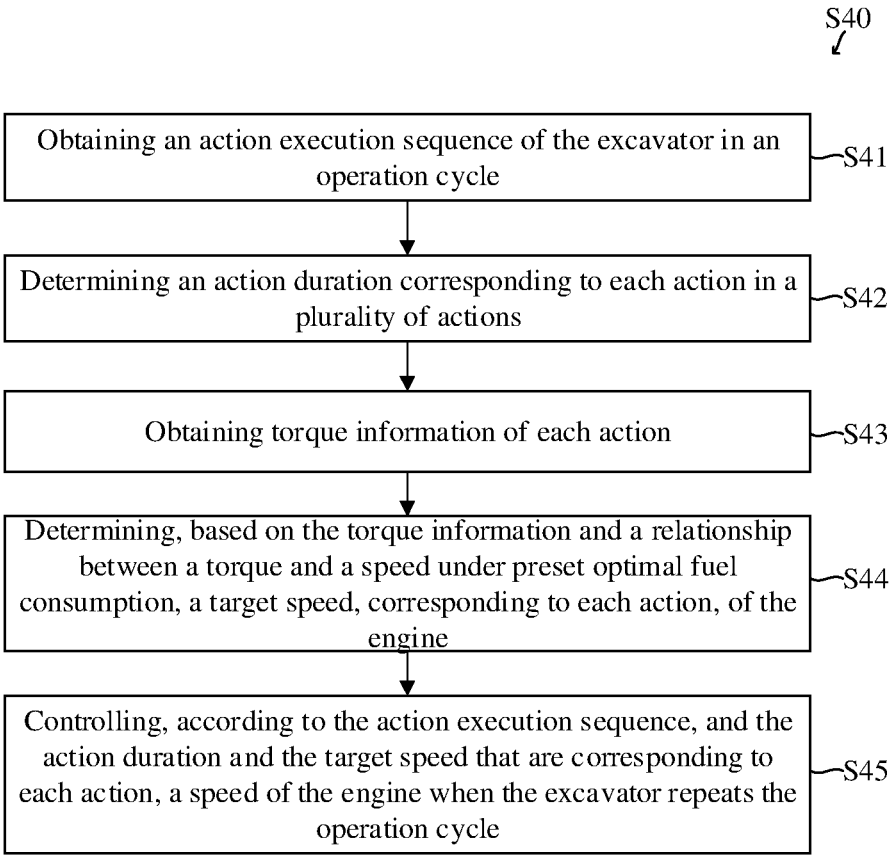
FIG. 5 a schematic flowchart of a control parameter adjusting method of an excavator according to an embodiment of the present disclosure.

In view of this, as shown in FIG. 5, a control parameter adjusting method S40 is provided by the present disclosure. Step S13 in the adaptive control method S10 aforementioned and step S23 in the adaptive control method S20 aforementioned may be implemented by the control parameter adjusting method S40. In the adjusting method S40, the control parameters include the engine speed of the excavator.

FIG. 5 is a schematic flowchart of the method S40. Referring to FIG. 5, the method S40 includes step S41 to step S45.

Step S41: obtaining an action execution sequence of the excavator in an operation cycle.

When the excavator performs a specific engineering operation, the action execution sequence is usually fixed. For example, when an excavator performs an excavation operation, a complete operation cycle includes excavation, rotation, unloading, and rotation return. An operation cycle may include a plurality of actions.

Normally, under a certain working condition, the excavator will repeatedly execute a certain operation cycle including multiple actions. In addition, for a certain operation cycle, the execution sequence of the included actions is usually fixed. For example, in a loading operation cycle, the excavator usually needs to perform multiple actions such as digging—lifting—slewing—unloading—returning. Thus, in some embodiments, the Step S41 may include: determining, based on the current working condition, an action execution sequence of the excavator in an operation cycle Step S42: determining an action duration corresponding to each action in a plurality of actions.

When the excavator is working, each action needs to last for a period of time, that is to say, each action has a corresponding action duration. Each action duration may be preset, may be determined based on a driver's actual operation, or may be set in another way. Therefore, when the action duration is determined, the action duration corresponding to each action may be obtained directly from an operation parameter of the excavator, or may be determined by monitoring changes of an action current of an operating handle. In other embodiments of the present disclosure, a corresponding action duration determining manner may alternatively be selected according to an actual action duration setting manner.

Step S43: obtaining torque information of each action.

Specifically, the torque information within the action duration corresponding to each action may be determined based on the action execution sequence. The torque information may be a torque percentage obtained directly from an engine, may be a torque value converted based on the torque percentage and a torque parameter of the engine, or the like. In the embodiment of the present disclosure, the torque value is used as an example for description. This is only an example, not a limitation.

Step S44: determining, based on the torque information and a relationship between a torque and a speed under preset optimal fuel consumption, a target speed, corresponding to each action, of the engine.

The relationship between a torque and a speed under preset optimal fuel consumption may be obtained according to a universal characteristic curve of the engine actually installed in the excavator. For example, the torque value corresponds to an output power of the engine. First a straight line is drawn on the universal characteristic curve, to make the straight line pass through all constant power curves. Each point on the straight line is moved along the constant power curves until a point with the lowest fuel consumption is found. The points obtained after moving are connected to obtain an optimal fuel consumption speed change curve. The optimal fuel consumption speed change curve may be used to represent the relationship between a torque and a speed under preset optimal fuel consumption. It should be noted that, the relationship between a torque and a speed under preset optimal fuel consumption may alternatively be obtained by using another method, and the present application is not limited thereto.

Exemplarily, the target speeds are obtained by taking points from the foregoing optimal fuel consumption speed change curve, and the corresponding relationship between the torque and the speed in the optimal fuel consumption speed change curve may include: (260, 1500), (310, 1590), (440, 1660), (750, 1750), (1000, 1910), and (1016, 1950).

In practical application, an engine speed is controlled, and meanwhile a proportional value of a change of the engine speed relative to a previous speed may also be calculated. A displacement of a hydraulic pump for performing actions on the excavator is adjusted according to the proportional value, so that a displacement of a main pump changes in an opposite direction according to proportional value, to ensure that output flow of the hydraulic pump remains unchanged, making an action of speed changing more stable.

Step S45: controlling, according to the action execution sequence, and the action duration and the target speed that are corresponding to each action, a speed of the engine when the excavator repeats the operation cycle.

Specifically, an action duration and a target speed that are corresponding to a current action may be determined according to the action execution sequence, and the engine is controlled to run at the corresponding target speed within the action duration corresponding to the current action.

When the excavator repeats operations, the speed of the engine may be controlled according to an action duration and a target speed that are corresponding to each action in each operation cycle. An excavator is still used as an example. For example, an operation cycle of the excavator may include a digging action and a rotating action. It is assumed that an action duration of the digging action is 30 s, and a corresponding target speed is 1800 rpm; an action duration of the rotating action is 10 s, and a corresponding target speed is 1600 rpm. In this case, when the excavator repeats operations, the engine may be controlled to run at a speed of 1800 rpm for 30 s first, and then run at a speed of 1600 rpm for 10 s in each operation cycle, and so on.

Based on the foregoing steps, according to the control parameter adjusting method provided in the embodiment of the present disclosure, an action duration of each action in an operation cycle is determined and used as a cycle for adjusting an engine speed, which reduces energy consumption of an engine, and also ensures action continuity during an operation of the excavator, thereby ensuring an operation effect. In addition, in the repetitive operation mode, after the action duration and a target speed that are corresponding to each action are obtained, periodic control of the engine speed may be automatically implemented. There is no need to perform individual control for each operation cycle, and a control method is simpler, which is conducive to engineering application.

Figure 6:
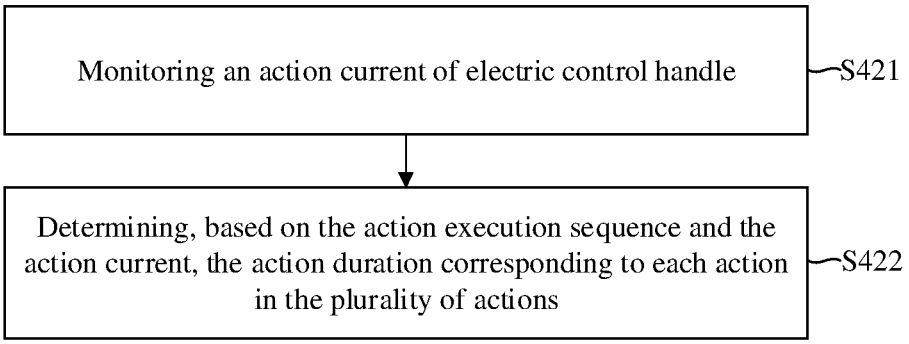
FIG. 6 a schematic flowchart of a control parameter adjusting method of an excavator according to another embodiment of the present disclosure.

FIG. 6 is a schematic flowchart of a control parameter adjusting method according to another embodiment of the present disclosure.

As shown in FIG. 6, in another embodiment, Step S42 in the embodiment illustrated in FIG. 5 may include step S421 and S422.

Step S421: monitoring an action current of the electric control handle; and

Step S422: determining, based on the action execution sequence and the action current, the action duration corresponding to each action in the plurality of actions.

Specifically, in a same operation cycle, when the excavator performs different actions, a type of an action currently being performed may be identified according to changes of the action current.

When the excavator performs an operation, each action needs to be controlled by an operating handle. Therefore, an execution state of each action may be determined by monitoring the action current of the operating handle. Specifically, when a driver performs a specific action by operating a handle, the action current gradually increases; and after the action is completed, the action current gradually decreases. When a next action is performed, a change trend of the action current remains the same. Therefore, according to the action execution sequence and the changes of the action current, the action duration corresponding to each action (that is, how long each action is performed) may be determined.

Based on the foregoing steps, according to the control parameter adjusting method provided in the embodiment of the present disclosure, an action duration of each action in an operation cycle is analyzed by utilizing an action current of the excavator, so that the action duration of each action of the excavator can be accurately obtained according to an actual situation, so as to adjust an engine speed in real time, further improving action continuity during an operation of the excavator.

Figure 7:
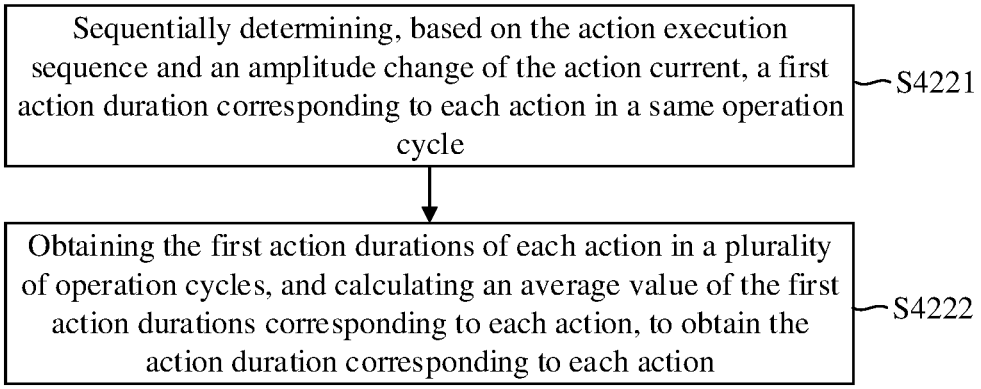
FIG. 7 a schematic flowchart of a control parameter adjusting method of an excavator according to another embodiment of the present disclosure.

FIG. 7 is a schematic flowchart of a control parameter adjusting method according to another embodiment of the present disclosure.

As shown in FIG. 7, in another embodiment, Step S422 in the embodiment illustrated in FIG. 6 may include step S4221 and step S4222.

Step S4221: sequentially determining, based on the action execution sequence and an amplitude change of the action current, a first action duration corresponding to each action in a same operation cycle.

A start moment and an end moment of each action may be determined according to the action execution sequence and the amplitude change of the action current, and a time length between the start moment and the end moment is a first action duration of a corresponding action. Specifically, when a time at which an amplitude of the action current is greater than a first threshold exceeds a first period, a moment at which the amplitude of the action current rises to the first threshold may be used as a first moment (namely, the start moment). When a time at which the amplitude of the action current is less than a second threshold exceeds a second period, a moment at which the amplitude of the action current drops to the second threshold may be used as a second moment (namely, the end moment). Herein the first threshold is greater than or equal to the second threshold. A first action duration corresponding to a current action is calculated based on the first moment and the second moment.

The first threshold is a minimum current value obtained when an action is started, and the second threshold is a maximum current value obtained when the action ends. The first threshold and second threshold may be the same or different, and specifically may be set flexibly according to an actual control precision requirement of an engine speed and an anti-interference capability, and the embodiment of the present disclosure is not limited thereto. The first period and the second period are used to avoid a problem of misjudgment of action start and/or action end caused by a sudden change of the action current due to external interference, improving accuracy of action identification. In application of time, the first period and the second period may be the same or different, and a specific setting value may be set according to an actual requirement, which is not limited in the embodiment of the present disclosure.

Specifically, before the first action duration corresponding to the current action is calculated based on the first moment and the second moment, the control parameter adjusting method further includes:

calculating a time difference between the second moment of the current action and a first moment of a next action; determining whether the time difference is less than a third period; and when the time difference is less than the third period, determining that the next action belongs to the current action, and updating the second moment of the current action to a second moment of the next action.

In other words, when a time difference between two detected actions is too short, it may be considered that the two actions actually belong to a same action, that is, a current action has not really completed, and a next action detected based on the amplitude change of the action current actually still belongs to the current action. For example, when an excavator encounters a hard rock when performing a digging action, the action current may drop briefly and then rise again. Then a controller detects a second moment and a new first moment, but actually the digging action is not completed, and the second moment detected by the controller is not a real second moment of the digging action. In this case, at a time when the second moment (for example, the moment when the current drops briefly) of the current action is detected, the current action is not actually completed, and the real second moment of the current action should be a detected second moment of the next action. Therefore, a real first action duration of the current action is actually a time difference between the first moment, detected by the controller, of the current action and the second moment of the next action.

For another example, the first action duration of the current action may alternatively be determined by using the following steps: calculating a time difference between a second moment corresponding to a previous action and a first moment of the current action; determining whether the time difference is less than a third period; and when the time difference is less than the third period, determining that the current action and the previous action belong to a same action, and using a first moment corresponding to the previous action as a start moment of the same action, and a second moment of the current action as an end moment of the same action.

Step S4222: Obtaining the first action durations of each action in a plurality of operation cycles, and calculating an average value of the first action durations corresponding to each action, to obtain the action duration corresponding to each action.

Specifically, the plurality of operation cycles may be set according to an actual control precision requirement, for example, may be 3 operation cycles or 5 operation cycles. In practical application, when an excavator repeats operations, an execution duration of each action in each operation cycle may fluctuate in some operation cycles due to an impact of an actual working condition. Therefore, execution durations of an action in a plurality of operation cycles are monitored, and an average time of the execution durations is used as an execution duration of the action, so as to further improve accuracy of an action duration corresponding to each execution action, which is conducive to improving precision of speed control during repeated operation of the excavator.

Figure 9:
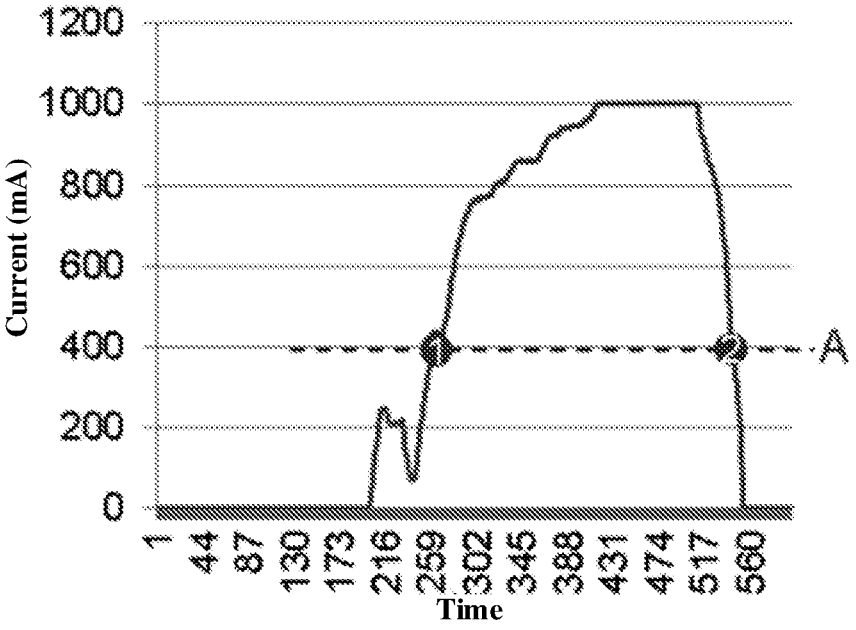
FIG. 9 is a specific schematic diagram for performing action identification based on an action current according to an embodiment of the present disclosure.

Exemplarily, FIG. 9 is a specific schematic diagram for performing action identification based on an action current according to the embodiment of the present disclosure. As shown in FIG. 9, A represents a no-action threshold. It may be considered that points below a represent no-action or invalid action. As a current increases and is gradually higher than A, it may be considered that an action is started. Over time, a complete action identification process is as follows:

(1) when data is not higher than line A, performing no processing, and keeping an action turned off;

(2) turning on a positive counter when it is detected that the data is higher than point ①;

(3) when the positive counter meets a threshold condition (that is, the current value is continuously higher than point ①), marking point ① as a moment at which an action is started;

(4) turning on a negative counter when it is detected that the current value is lower than point ②; and (5) when the negative counter meets a threshold condition (that is, the current value is continuously lower than point ②), marking point ② as a moment at which the action ends.

A role of the positive counter and the negative counter is to avoid misjudgment caused by an instantaneous current fluctuation.

In addition, when it is detected that a next action is started, a time difference between a current time and a time at which a previous action ends is calculated for comparison. If the time difference is too short, it is considered that both actions belong to a same action. In this case, the detected next action is not marked as a new action, and an action duration corresponding to the previous action is updated, so as to further improve precision of action identification, thereby improving precision of engine speed control, which is conducive to maintaining continuity of execution actions and reducing engine fuel consumption.

For example, the following steps may be used: calculating a time difference between a second moment corresponding to a previous action and a current first moment; determining whether the time difference is less than a third period; when the time difference is less than the third period, extracting, after the current first moment from an action current, a third moment when a time at which an amplitude of the action current is less than a second threshold exceeds a second period; and updating the third moment to the second moment corresponding to the previous action.

Figure 8:
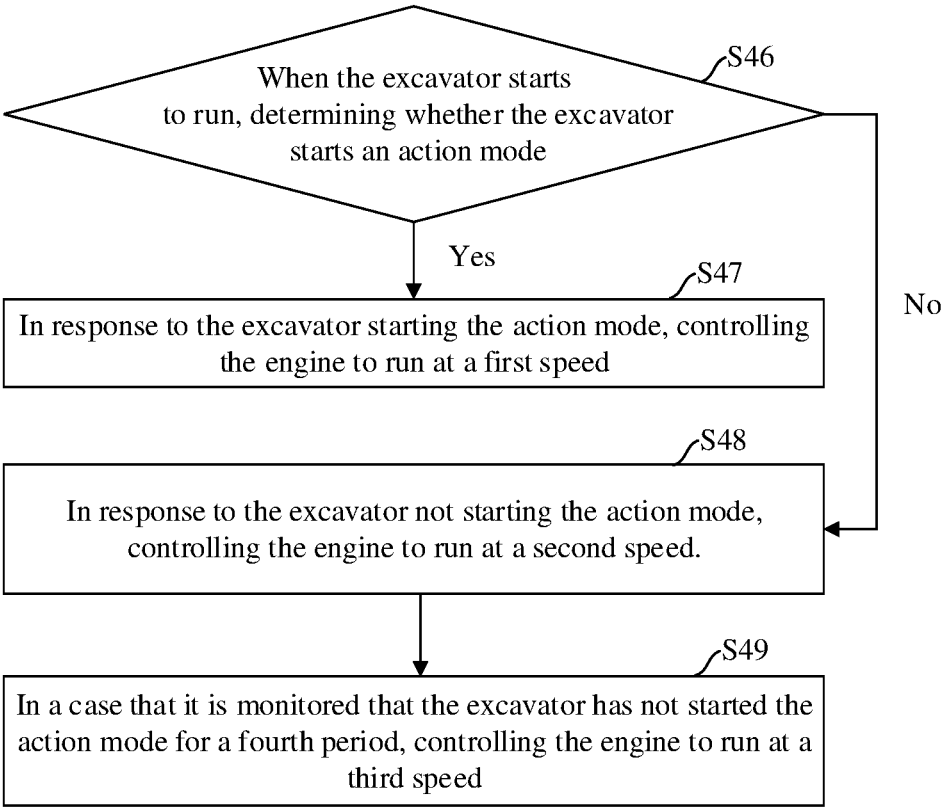
FIG. 8 a schematic flowchart of a control parameter adjusting method of an excavator according to another embodiment of the present disclosure.

FIG. 8 is a schematic flowchart of a control parameter adjusting method according to another embodiment of the present disclosure.

As shown in FIG. 8, in another embodiment, before Step S41 shown in FIG. 5 is performed, the control parameter adjusting method further includes step S46 to step S49.

Step S46: When the excavator starts to run, determining whether the excavator starts an action mode.

After the excavator is started, a driver needs to turn on a "pilot" of the excavator before controlling a handle to control the excavator to perform a corresponding action. Only when the "pilot" is turned on, can the excavator be controlled to perform actions. The "pilot" disposed on the excavator is a pilot switch, which is used to control a signal for the excavator to start an action mode. Only when the "pilot" is turned on, the excavator is in the action mode.

Step S47: in response to the excavator starting the action mode, controlling the engine to run at a first speed.

The first speed is a speed set, when the "pilot" of the excavator is turned on, to avoid a slow response of engine speed control of the excavator due to a sudden increase in both load and speed when the driver suddenly operates the handle to perform an action. The speed is a relatively high speed, such as 1500 rpm. This is only an example in the embodiment of the present disclosure, not a limitation.

Step S48: in response to the excavator not starting the action mode, controlling the engine to run at a second speed.

The second speed is less than the first speed. Specifically, if the "pilot" of the excavator is in an off state, it indicates that the excavator cannot perform any action. In this case, the engine is controlled to run at a relatively low speed to reduce fuel consumption, for example, the second speed may be 1300 rpm. In practical application, the second speed may be set according to an actual requirement of the excavator. The lower the second speed, the lower the fuel consumption, but a response speed for performing an action is affected. On the contrary, the higher the second speed, the faster the response speed, but the fuel consumption is higher. An appropriate second speed may be selected according to importance of the two conditions to the excavator, and the embodiment of the present disclosure is not limited thereto.

Step S49: in a case that it is monitored that the excavator has not started the action mode for a fourth period, controlling the engine to run at a third speed.

The third speed is lower than the second speed. Specifically, if the "pilot" of the excavator has been in the off state for the fourth period, such as 5 s, the engine is further controlled to reduce its speed, to ensure that the engine runs in a low speed when there is no action. For example, the engine may be controlled to run at 1100 rpm to further reduce fuel consumption. Similarly, the third speed and the fourth period may also be set according to an actual requirement of the excavator, which are not limited in the embodiment of the present disclosure.

Based on the foregoing steps, according to the control parameter adjusting method provided in the embodiment of the present disclosure, an action duration of each action in an operation cycle is analyzed by utilizing an action current of the excavator, and used as a cycle for adjusting an engine speed, which reduces energy consumption of an engine, and also ensures action continuity during an operation of the excavator, thereby ensuring an operation effect. In addition, in the repetitive operation mode, after the action duration and a target speed that are corresponding to each action are obtained, periodic control of the engine speed may be automatically implemented. There is no need to perform individual control for each operation cycle, and a control method is simpler, which is conducive to engineering application. In addition, manual intervention is not required in an entire speed control process, and an operator does not feel a speed change of an actuator, which is in line with practical engineering applications.

The present embodiment also provides an adaptive control apparatus, applicable to an excavator. The adaptive control apparatus provided in the present disclosure corresponds to the adaptive control method provided in the present disclosure one-to-one. Repeated description is omitted as appropriate for the sake of brevity. As used below, the term "module" may be a combination of software and/or hardware that implements a predetermined function. Although the apparatus described in the following embodiments is preferably implemented in software, hardware, or a combination of software and hardware, is also possible and contemplated.

Figure 10:
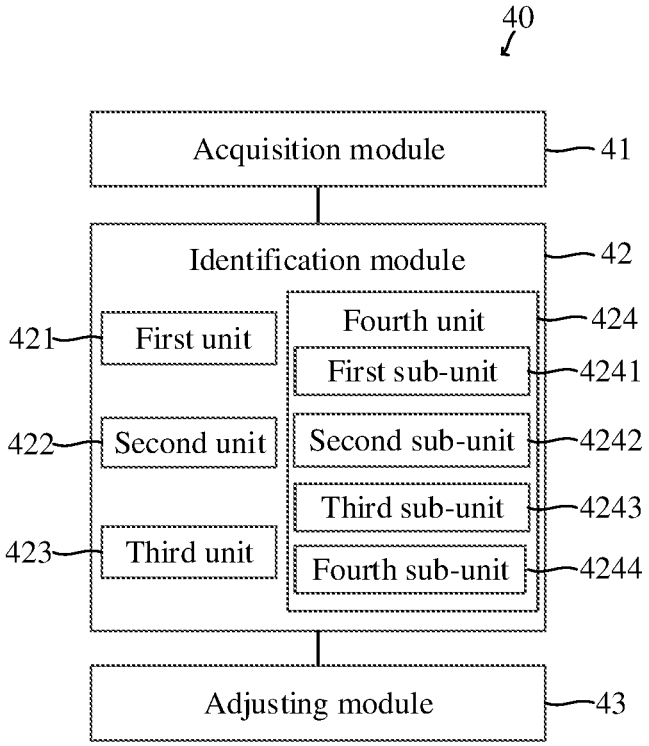
FIG. 10 is a schematic structural diagram of an adaptive control apparatus according to an embodiment of the present disclosure.

FIG. 10 is a schematic structural diagram of an adaptive control apparatus 40 according to an embodiment of the present disclosure. As shown in FIG. 10, the adaptive control apparatus 40 may include an acquisition module 41, an identification module 42, and an adjusting module 43.

The acquisition module 41 is configured to acquire detection parameters of the excavator. The detection parameters include a displacement of an electric control handle of the excavator and angle information of the excavator.

The identification module 42 is configured to identify a current working condition of the excavator based on the detection parameters.

The adjusting module 43 is configured to adjust control parameters of the excavator based on the current working condition.

The adaptive control apparatus, applicable to the excavator, in this embodiment is presented in the form of a functional unit, which may adopt one or a combination of the following forms: an ASIC circuit, a processor that executes one or more software or fixed programs, and other components that may provide the above functions.

In some embodiments, referring again to FIG. 10, the identification module 42 may include a first unit 421, a second unit 422, a third unit 423, and a fourth unit 424. The angle information may include inclination angles of a plurality of action mechanisms of the excavator and a swing angle of a swing platform of the excavator.

The first unit 421 is configured to acquire relative positions of the plurality of action mechanisms. The second unit 422 is configured to determine a lift height of the excavator based on the inclination angles and the relative positions. The third unit 423 is configured to determine target speeds of the plurality of actuators based on the displacement and a correspondence between speeds of the plurality of actuators and the displacement of the electric control handle. The fourth unit 424 is configured to determine the current working condition based on the angle information, the lift height, and the target speeds.

In some embodiments, the second unit 422 is configured to: determine a spatial coordinate of a tooth tip of the excavator at each time based on the inclination angles and the relative positions; determine a motion trajectory of the tooth tip based on the spatial coordinate of the tooth tip at each time; and determine a height difference between a crawler of the excavator and a working surface of the excavator based on the motion trajectory of the tooth tip, so as to determine the lift height.

In some embodiments, referring again to FIG. 10, the fourth unit 424 may include a first sub-unit 4241, a second sub-unit 4242, a third sub-unit 4243, and a fourth sub-unit 4244.

The first sub-unit 4241 is configured to determine that the excavator is currently in a first mode based on the lift height. The first mode is one of a platform building operation and a ground operation.

The second sub-unit 4242 is configured to determine that the excavator is currently in a second mode based on the inclination angles and the target speeds. The second mode is one of a loading operation and a dumping operation.

The third sub-unit 4243 is configured to determine that the excavator is currently in a third mode based on the swing angle. The third mode is one of a plurality of swing operations with different swing angles.

The fourth sub-unit 4244 is configured to determine the current working condition based on the first mode, the second mode and the third mode.

In some embodiments, the first sub-unit is configured to: determine whether the lift height exceeds a height threshold; determine that the excavator is in the platform building operation when the lift height does not exceed the height threshold; and determine that the excavator is in the ground operation when the lift height exceeds the height threshold.

In some embodiments, the second sub-unit is configured to: determine speed of the electric control handle based on the displacement of the electric control handle; determine target accelerations of the plurality of actuators based on the speed of the electric control handle; and determine that the excavator is currently in the second mode based on the inclination angles, the target speeds, and the target accelerations.

In some embodiments, the adjusting module 43 is configured to: determine target control parameters based on the current working condition and an optimization target; and adjust the control parameters based on the target control parameters. The optimization target include minimum fuel consumption and maximum efficiency.

Figure 11:
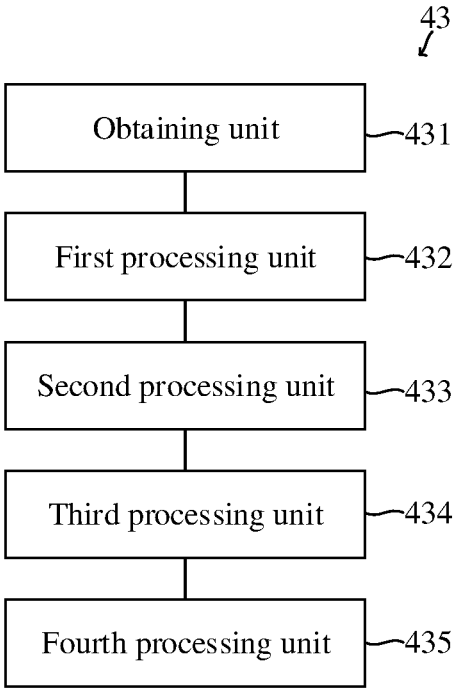
FIG. 11 is a schematic structure diagram of an adjusting module according to an embodiment of the present disclosure.

FIG. 11 is a schematic structural diagram of the control parameters adjusting module 43 according to the embodiment of the present disclosure. As shown in FIG. 11, the control parameters adjusting module 43 specifically includes: an obtaining unit 431, a first processing unit 432, a second processing unit 433, a third processing unit 434, and a fourth processing unit 435.

The obtaining unit 431 is configured to obtain an action execution sequence of the excavator in an operation cycle, where for details, see related description in Step S41 in the foregoing method embodiment, and details are not repeated herein.

The first processing unit 432 is configured to determine an action duration corresponding to each action in a plurality of actions in the operation cycle, where for details, see related description in Step S42 in the foregoing method embodiment, and details are not repeated herein.

The second processing unit 433 is configured to obtain torque information of each action, where for details, see related description in Step S43 in the foregoing method embodiment, and details are not repeated herein.

The third processing unit 434 is configured to determine, based torque information and a relationship between a torque and a speed under preset optimal fuel consumption, a target speed, of an engine, corresponding to a current action, where for details, see related description in Step S44 in the foregoing method embodiment, and details are not repeated herein.

The fourth processing unit 435 is configured to control, according to the action execution sequence, and the action duration and the target speed that are corresponding to each action, a speed of the engine when the excavator repeats the operation cycle, where for details, see related description in Step S45 in the foregoing method embodiment, and details are not repeated herein.

The adjusting module provided in the embodiment of the present disclosure is used to perform the control parameter adjusting method provided in the foregoing embodiments, and has the same implementation manners and principle as the method embodiments. For details, see related descriptions in the foregoing method embodiments, which will not be repeated.

Based on cooperation of the foregoing components, according to the adjusting module provided in the embodiment of the present disclosure, an action duration of each action in an operation cycle is determined and used as a cycle for adjusting an engine speed, which reduces energy consumption of an engine, and also ensures action continuity during an operation of the excavator, thereby ensuring an operation effect. In addition, in the repetitive operation mode, after the action duration and a target speed that are corresponding to each action are obtained, periodic control of the engine speed may be automatically implemented. There is no need to perform individual control for each operation cycle, and a control method is simpler, which is conducive to engineering application.

Optionally, in another embodiment, the fourth processing unit 435 is specifically configured to control an engine to run at a target speed corresponding to a current action within an action duration corresponding to the current action.

Optionally, in another embodiment, the first processing unit 432 is specifically configured to: monitor an action current of the excavator; and determine, based on the action execution sequence and the action current, the action duration corresponding to each action in the plurality of actions.

Further, in another embodiment, the first processing unit 432 is specifically configured to: sequentially determine, based on the action execution sequence and an amplitude change of the action current, a first action duration corresponding to each action in a same operation cycle; and obtain the first action durations of each action in a plurality of operation cycles, and calculate an average value of the first action durations corresponding to each action, to obtain the action duration corresponding to each action.

Optionally, in another embodiment, a manner in which the first processing unit 432 determines the first action duration includes: determining a first moment and a second moment of the current action based on the amplitude change of the action current, where the first moment is a start moment of an action, and the second moment is an end moment of an action; and calculating, based on the first moment and the second moment, a first action duration corresponding to the current action.

Specifically, in an embodiment, a manner in which the first processing unit 432 determines the first moment and the second moment of the current action based on the amplitude change of the action current may include: according to the action execution sequence, when a time at which an amplitude of the action current is greater than a first threshold exceeds a first period, determining that a moment at which the amplitude of the action current rises to the first threshold is the first moment; and when a time at which an amplitude of the action current is less than a second threshold exceeds a second period, determining that a moment at which the amplitude of the action current drops to the second threshold is the second moment. The first threshold is greater than the second threshold.

Optionally, in another embodiment, before calculating, based on the first moment and the second moment, the first action duration corresponding to the current action, the first processing unit 432 may determine accuracy of the second moment. Specifically, the first processing unit 432 may calculate a time difference between the second moment of the current action and a first moment of a next action, and determine whether the time difference is less than a third period; and when it is determined that the time difference is less than the third period, determine that the next action belongs to the current action, and update the second moment of the current action to a second moment of the next action.

Optionally, in another embodiment, the control parameters adjusting module may further include:

a determining module, configured to: when the excavator starts to run, determine whether the excavator starts an action mode, where for details, see related description in Step S46 in the foregoing method embodiment, and details are not repeated herein; and a first control module, configured to: when the excavator starts the action mode, control the engine to run at a first speed, where for details, see related description in Step S47 in the foregoing method embodiment, and details are not repeated herein.

Optionally, in another embodiment, the control parameters adjusting module may further include:

a second control module, configured to: when the excavator does not start the action mode, control the engine to run at a second speed. For details, see related description in Step S48 in the foregoing method embodiment, and details are not repeated herein.

Optionally, in another embodiment, the second control module may further be configured to: when it is monitored that the excavator has not started the action mode for a fourth period, control the engine to run at a third speed. For details, see related description in Step S49 in the foregoing method embodiment, and details are not repeated herein.

Figure 12:
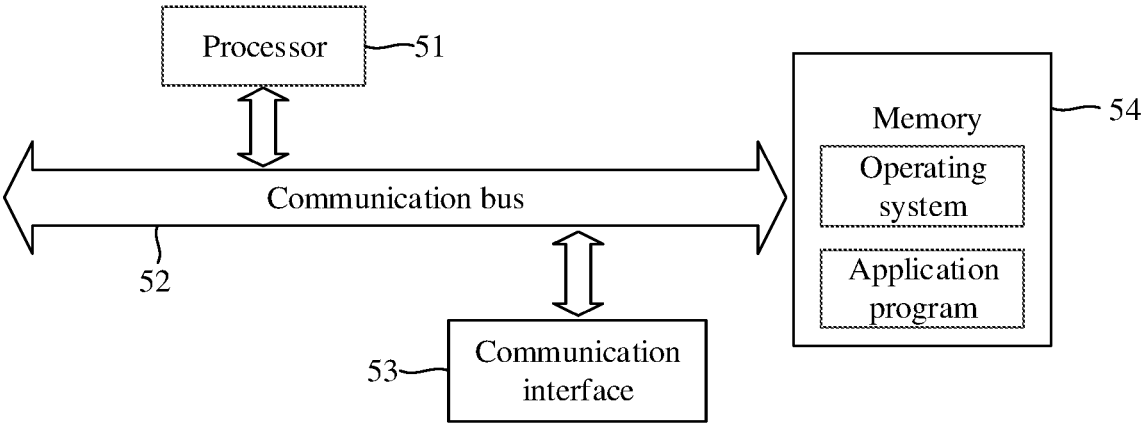
FIG. 12 is a schematic structural diagram of an electronic device according to an embodiment of the present disclosure.

FIG. 12 is a schematic structural diagram of an electronic device 50 according to an embodiment of the present disclosure. As shown in FIG. 12, the electronic device 50 may include at least one processor 51, at least one communication interface 53, a memory 54, and at least one communication bus 52. The communication bus 52 is used to realize connection communication between these components. The communication interface 53 may include a display screen and a keyboard, and the communication interface 53 may optionally also include a standard wired interface and a wireless interface. The memory 54 may be a high-speed Random Access Memory (RAM) or a non-volatile memory, such as at least one disk memory. The memory 54 may alternatively be at least one storage apparatus located away from the aforementioned processor 51. The processor 51 may call program code stored in the memory 54 for performing any of the steps in any of the methods described above.

The communication bus 52 may be a Peripheral Component Interconnect (PCI) bus, an Extended Industry Standard Architecture (EISA) bus, or the like. The communication bus 52 may be divided into an address bus, a data bus, control bus, or the like.

The memory 54 may include a volatile memory, such as a Random Access Memory (RAM); The memory may also include a non-volatile memory, such as a flash memory, a Hard Disk Drive (HDD), or a Solid State Drive (SSD). The memory 54 may also include a combination of the above types of memories.

The processor 51 may be a Central Processing Unit (CPU), a Network Processor (NP), or a combination of CPU and NP.

The processor 51 may further include a hardware chip. The above hardware chip may be an Application Specific Integrated Circuit (ASIC), a Programmable Logic Device (PLD), or a combination thereof. The PLD may be a Complex Programmable Logic Device (CPLD), a Field Programmable Gate Array (FPGA), a General Array Logic (GAL), or any combination thereof.

Optionally, the memory 54 is also used to store program instructions. The processor 51 may call the program instructions to implement the adaptive control method shown in the embodiments of FIG. 1 to FIG. 8 of the present application.

The present disclosure also provides a non-transitory storage medium. The non-transitory storage medium stores program instructions. When the program instructions are executed by the processor, the processor executes the adaptive control method provided by the present disclosure.

In the present disclosure, the computer storage medium may be a magnetic disk, an optical disk, a Read Only Memory (ROM), a Random Access Memory (RAM), a flash memory, a Hard Disk Drive (HDD), a Solid State Drive (SSD), and the like. In some embodiments, the computer storage medium may also include a combination of the above types of memories.

The present disclosure also provides an excavator including the electronic device provided in the present disclosure.

By way of example, the excavator may include an excavator body and the electronic device. The electronic device is connected with the excavator body. The electronic device may be connected with the excavator body according to the needs. The specific connection manner and setting position of the excavator and the electronic device are not limited here.

The specific structure of the excavator body may be set according to the actual needs, and there is no limitation here. The electronic device is used to automatically identify the current working condition of the excavator, and adaptively adjust the control parameters of the excavator based on the current working condition, so that the excavator may automatically adapt to different working conditions, thereby reducing the working difficulty, increasing the working efficiency, and eliminating the need for the driver to manually select the working mode.

It should be noted that in the present disclosure, the excavator may include a traveling mechanism, a swing platform, and a plurality of action mechanisms. For example, the traveling mechanism may be a crawler. The swing platform is also called an upper part turntable or an upper part body, which is installed on the traveling mechanism. The swing platform may include, for example, a cab and counterweights, etc. The plurality of action mechanisms may include a boom, a stick and a bucket, etc. The plurality of action mechanisms are installed on the swing platform to follow the swing platform to rotate.

It should be noted that, in the present disclosure, the loading operation may mean that the excavator loads materials onto another transport vehicle (e.g., a truck); the dumping operation may mean that the excavator directly moves materials from one place to another without the help of other transportation vehicles. It should also be noted that, in the present disclosure, the platform building operation may mean that the excavator working on a pre-built platform. Correspondingly, the ground operation may mean that the excavator operates on a flat ground. For example, in one loading operation, if the excavator and the truck are on a same plane (i.e., a ground height supporting the excavator and the truck are the same), this operation manner may be called the ground operation. If the plane where the excavator is located is higher than the plane where the truck is located (for example, the truck is on the ground and the excavator is on a platform higher than the ground), this operation manner may be called the platform building operation. In a loading and unloading operation, as for a same truck, if the platform building operation is adopted, the lift height of the bucket of the excavator is low; if the ground operation is adopted, the bucket of the excavator needs to be lifted to a higher height.

Those skilled in the art may understand that implementing all or some of processes in the methods of the foregoing embodiments may be completed by instructing relevant hardware through a computer program. The program may be stored in a non-transitory storage medium. When the program is executed, processes of the foregoing method embodiments may be included. The storage medium may be a magnetic disk, an optical disk, a read-only memory (ROM), a random access memory (RAM), a flash memory, a hard disk drive (HDD), a solid-state drive (SSD), or the like. The storage medium may alternatively be a combination of the foregoing types of memories.

Although the embodiments of the present disclosure have been described in conjunction with the drawings, those skilled in the art may make various modifications and variations without departing from the spirit and scope of the present disclosure, and such modifications and variations fall within the scope defined by the appended claims.

What is claimed is:

1. An adaptive control method, applicable to an excavator, wherein the adaptive control method comprises:

acquiring detection parameters of the excavator, wherein the detection parameters comprise a displacement of an electric control handle of the excavator and angle information of the excavator, the excavator comprises a plurality of actuators, the plurality of actuators comprise a plurality of action mechanisms and a swing platform, and the angle information comprises inclination angles of the plurality of action mechanisms and a swing angle of the swing platform;

identifying a current working condition of the excavator based on the detection parameters;

adjusting control parameters of the excavator based on the current working condition; and controlling the excavator to operate based on the adjusted control parameters, wherein the identifying the current working condition of the excavator based on the detection parameters comprises:

acquiring relative positions of the plurality of action mechanisms;

determining a lift height of the excavator based on the inclination angles and the relative positions;

determining target speeds of the plurality of actuators based on the displacement and a correspondence between speeds of the plurality of actuators and the displacement of the electric control handle; and determining the current working condition based on the angle information, the lift height, and the target speeds;

wherein the determining the lift height of the excavator based on the inclination angles and the relative positions comprises:

determining a spatial coordinate of a tooth tip of the excavator at each time based on the inclination angles and the relative positions;

determining a motion trajectory of the tooth tip based on the spatial coordinate of the tooth tip at each time; and determining a height difference between a crawler of the excavator and a working surface of the excavator based on the motion trajectory of the tooth tip, so as to determine the lift height.

2. The adaptive control method of claim 1, wherein the determining the current working condition based on the angle information, the lift height, and the target speeds comprises:

determining that the excavator is currently in a first mode based on the lift height, the first mode being one of a platform building operation and a ground operation;

determining that the excavator is currently in a second mode based on the inclination angles and the target speeds, the second mode being one of a loading operation and a dumping operation;

determining that the excavator is currently in a third mode based on the swing angle, the third mode being one of a plurality of swing operations with different swing angles; and determining the current working condition based on the first mode, the second mode and the third mode.

3. The adaptive control method of claim 2, wherein the determining that the excavator is currently in the first mode based on the lift height comprises:

determining whether the lift height exceeds a height threshold;

determining that the excavator is in the platform building operation when the lift height does not exceed the height threshold; and determining that the excavator is in the ground operation when the lift height exceeds the height threshold.

4. The adaptive control method of claim 2, wherein the determining that the excavator is currently in the second mode based on the inclination angles and the target speeds comprises:

determining speed of the electric control handle based on the displacement of the electric control handle;

determining target accelerations of the plurality of actuators based on the speed of the electric control handle; and determining that the excavator is currently in the second mode based on the inclination angles, the target speeds, and the target accelerations.

5. The adaptive control method of claim 1, wherein the plurality of action mechanisms comprise a boom, a stick and a bucket.

6. The adaptive control method of claim 1, wherein the control parameters comprise a pump current and a priority gain, the adjusting control parameters of the excavator based on the current working condition comprises:

determining target control parameters based on the current working condition and an optimization target, the optimization target comprising minimum fuel consumption and maximum efficiency; and adjusting the control parameters based on the target control parameters.

7. The adaptive control method of claim 1, wherein the control parameters comprise a speed of an engine of the excavator, the adjusting control parameters of the excavator based on the current working condition comprises:

determining, based on the current working condition, an action execution sequence of the excavator in an operation cycle;

determining an action duration corresponding to each action of a plurality of actions in the operation cycle;

obtaining torque information of each action;

determining, based on the torque information and a relationship between a torque and a speed under preset optimal fuel consumption, a target speed, corresponding to each action, of an engine; and controlling, according to the action execution sequence, and the action duration and the target speed that are corresponding to each action, the speed of the engine when the excavator repeats the operation cycle.

8. The adaptive control method of claim 7, wherein the controlling, according to the action execution sequence, and the action duration and the target speed that are corresponding to each action, a speed of the engine comprises:

controlling the engine to run at a target speed corresponding to a current action within an action duration corresponding to the current action.

9. The adaptive control method of claim 7, wherein the determining the action duration corresponding to each action in the plurality of actions in the operation cycle comprises:

monitoring an action current of the electric control handle; and determining, based on the action execution sequence and the action current, the action duration corresponding to each action in the plurality of actions.

10. The adaptive control method of claim 9, wherein the determining, based on the action execution sequence and the action current, the action duration corresponding to each action in the plurality of actions comprises:

sequentially determining, based on the action execution sequence and an amplitude change of the action current, a first action duration corresponding to each action in a same operation cycle; and obtaining the first action durations of each action in a plurality of operation cycles, and calculating an average value of the first action durations corresponding to each action, to obtain the action duration corresponding to each action.

11. The adaptive control method of claim 10, wherein the sequentially determining, based on the action execution sequence and an amplitude change of the action current, a first action duration corresponding to each action in a same operation cycle comprises:

determining a first moment and a second moment of the current action based on the amplitude change of the action current, wherein the first moment is a start moment of an action, and the second moment is an end moment of an action; and calculating, based on the first moment and the second moment, a first action duration corresponding to the current action.

12. The adaptive control method of claim 11, wherein the determining the first moment and the second moment of the current action based on the amplitude change of the action current comprises:

in a case that a period during which an amplitude of the action current is greater than a first threshold exceeds a first period, determining that a moment at which the amplitude of the action current rises to the first threshold is the first moment; and in a case that a period during which an amplitude of the action current is less than a second threshold exceeds a second period, determining that a moment at which the amplitude of the action current drops to the second threshold is the second moment, wherein the first threshold is greater than or equal to the second threshold.

13. The adaptive control method of claim 11, wherein before the calculating, based on the first moment and the second moment, a first action duration corresponding to the current action, the method further comprises:

calculating a time difference between the second moment of the current action and a first moment of a next action;

determining whether the time difference is less than a third period; and in a case that the time difference is less than the third period, determining that the next action belongs to the current action, and updating the second moment of the current action to a second moment of the next action.

14. The adaptive control method of claim 7, further comprising:

determining whether the excavator starts an action mode when the excavator starts to run;

controlling the engine to run at a first speed in response to the excavator starting the action mode; and controlling the engine to run at a second speed in response to the excavator not starting the action mode, wherein the second speed is less than the first speed.

15. The adaptive control method of claim 14, further comprising:

in a case that it is monitored that the excavator has not started the action mode for a fourth period, controlling the engine to run at a third speed, wherein the third speed is less than the second speed.

16. An electronic device, comprising:

a processor; and a memory having program instructions stored thereon and coupled to the processor, wherein when the program instructions are executed by the processor, the processor executes the adaptive control method of claim 1.

17. An excavator, comprising the electronic device of claim 16.

18. A non-transitory storage medium having program instructions stored thereon, wherein when the program instructions are executed by a processor, the processor executes the adaptive control method of claim 1.

* * * * *